United States Patent [19]

Davis et al.

[11] Patent Number: 4,786,232

[45] Date of Patent: Nov. 22, 1988

[54] FLOATING EXPANSION CONTROL RING

[75] Inventors: Warren W. Davis, Dunlap; Michael W. Kipling, Washington, both of Ill.

[73] Assignee: Caterpillar Inc., Peoria, Ill.

[21] Appl. No.: 880,763

[22] Filed: Jul. 1, 1986

Related U.S. Application Data

[63] Continuation of Ser. No. 280,381, Apr. 10, 1981, abandoned.

[51] Int. Cl.[4] ..... F01D 11/08

[52] U.S. Cl. ..... 415/138

[58] Field of Search ..... 415/136, 138, 134

[56] References Cited

U.S. PATENT DOCUMENTS

| | | | |
|---|---|---|---|
| 2,999,670 | 9/1961 | Payne et al. | 415/136 |
| 3,066,911 | 12/1962 | Anderson et al. | 415/138 |
| 3,227,418 | 1/1966 | West | 415/136 |
| 3,520,635 | 7/1970 | Killmann et al. | 415/138 |
| 4,251,185 | 2/1981 | Karstensen | 415/136 |
| 4,307,993 | 12/1981 | Hartel | 415/136 |

FOREIGN PATENT DOCUMENTS

| | | | |
|---|---|---|---|
| 1285255 | 12/1968 | Fed. Rep. of Germany | 415/138 |
| 222283 | 10/1924 | United Kingdom | 415/136 |
| 243027 | 12/1925 | United Kingdom | 415/138 |

*Primary Examiner*—Robert E. Garrett
*Assistant Examiner*—John T. Kwon
*Attorney, Agent, or Firm*—Larry G. Cain

[57] ABSTRACT

A floating expansion control ring (20) having a plurality of radially extending positioning lugs (18) is free to move eccentric to the axis of an enclosing engine (24) and within the confines of a spacer ring (14) rigidly mounted within said engine (24). This eccentric movement in a turbine engine permits slight eccentricities of a turbine rotor (11) in a turbine engine. This eccentric movement eliminates the need for abradable shrouds and abradable turbine blades.

4 Claims, 2 Drawing Sheets

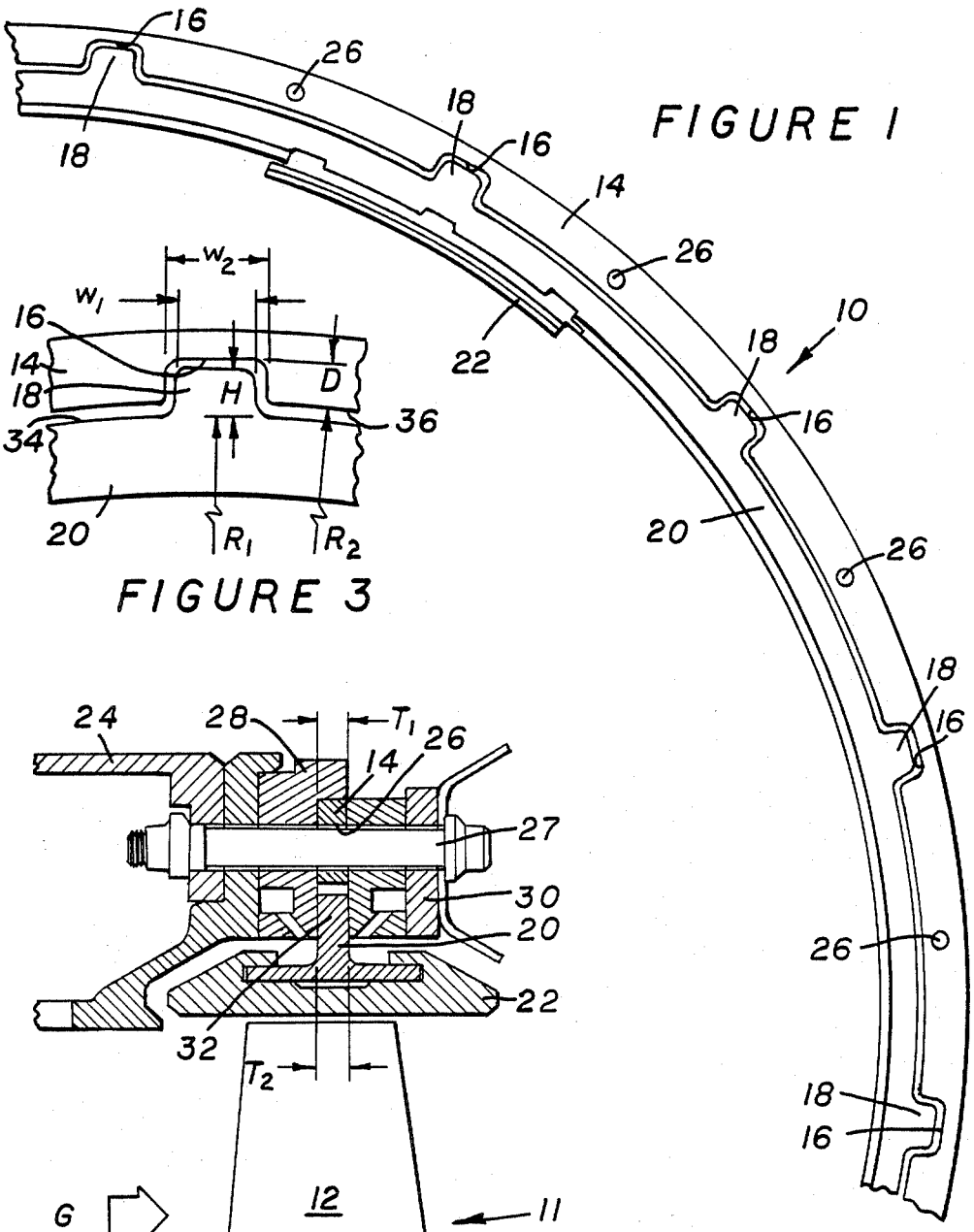
FIGURE 1
FIGURE 3
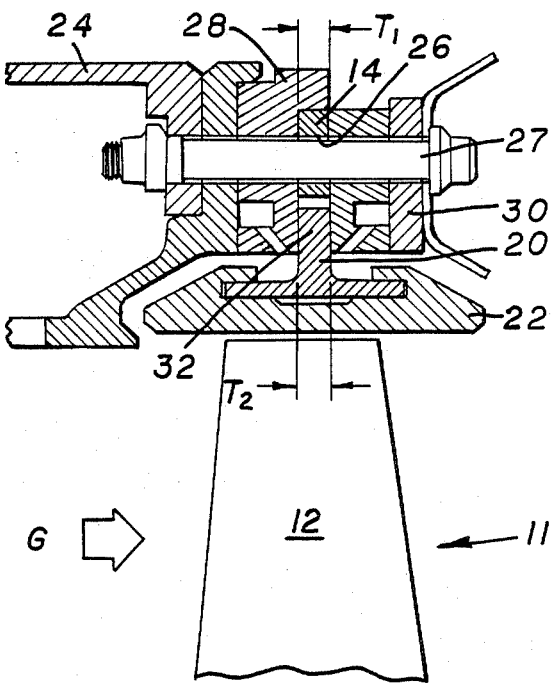
FIGURE 2

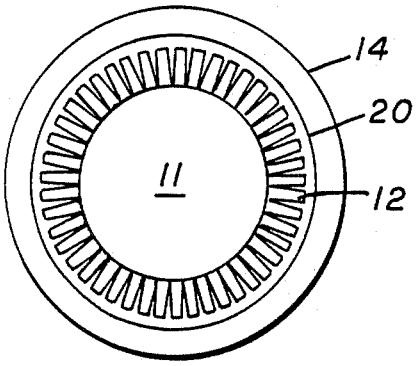
FIGURE 4-A
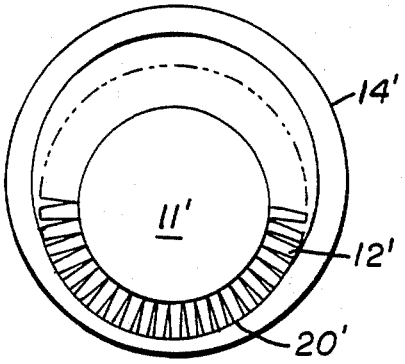
FIGURE 4-B
(Prior Art)
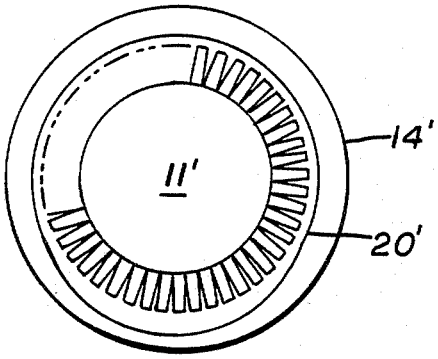
FIGURE 4-C
(Prior Art)
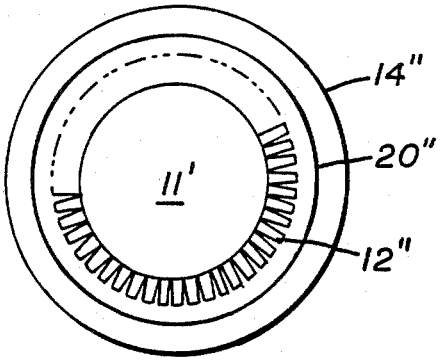
FIGURE 4-D
(Prior Art)
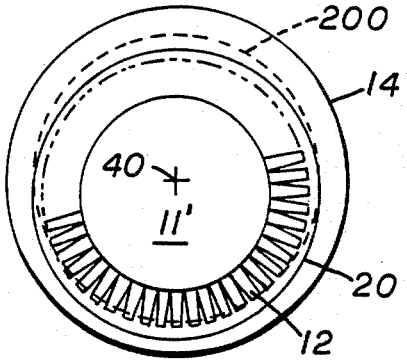
FIGURE 4-E

FLOATING EXPANSION CONTROL RING

This is a continuation of Ser. No. 280,381, filed Apr. 10, 1981, now abandoned.

DESCRIPTION

Technical Field

This invention relates generally to turbine engines and more particularly to an expansion control ring mounted about the gasifier turbine in a gas turbine engine.

Gas turbine engines, in order to operate efficiently, must maintain a relatively close tolerance between the turbine blades and the surrounding engine. This is necessary in order to minimize the loss of power due to expanding gases passing between the end of the turbine blade and the surrounding shroud. In any turbine engine, expansion of the turbine wheel relative the engine shroud is a problem which must be dealt with during design and in some cases, during engine operation. While this invention deals specifically with a gas turbine environment, it would be equally applicable to a steam turbine environment.

As noted above, the efficiency of a gas turbine engine to a great extent depends on the "tightness" of the gas stream passing the gasifier turbine. When the hot gases impinge on the turbine wheel and the extending turbine blades, there is considerable expansion of the turbine wheel. In order to maintain the close fit between the turbine wheel and the surrounding turbine shroud structure, several actions can be taken. First, it is appropriate to attempt to ensure that the rate of expansion of the turbine shroud structure is essentially the same or is slightly greater than the rate of expansion of the turbine wheel. In order to achieve this, it is necessary to design the turbine shroud structure so it expands equally throughout its entire circumference. This type of structure is taught in U.S. Pat. No. 4,251,185 for "An Expansion Control Ring for a Turbine Shroud Assembly" issued to Karl W. Karstensen on Feb. 17, 1981. While the structure disclosed in the aforesaid patent permits expansion of the shroud assembly concentric with the engine axis, it does not eliminate the necessity for some sort of additional clearance between the turbine blades and the shroud to compensate for transient inconsistencies in the expansion of the turbine wheel that result in temporary eccentricities of the turbine wheel during acceleration or deceleration of the engine. Accordingly, in the aforesaid patent an abradable shroud structure is also utilized. Such a shroud structure permits contact of the various turbine blades with the shroud structure without undue injury to the turbine blades. Specifically, the abradable portion of the shroud structure is made softer than the turbine blade so that upon such contact, the shroud structure is worn away.

In other applications, the tip of the turbine blade is designed so that a certain amount of a turbine blade tip will wear away. These type turbine blades are commonly called "squealer tips" stemming from the fact that the contact of the blade with the turbine shroud causes a "squeal." A unique disadvantage of a "squealer tip" blade is that the cooling passages normally found in gasifier turbine blades are easily blocked by the abrasion of the turbine tip. Once the cooling passages are blocked in the turbine blade, the turbine blade is subject to overheating and subsequent failure.

In both the abradable shroud type structure and the "squealer tip" type structure, the clearance between the turbine wheel and the shroud structure is permanently increased every time there is contact between the turbine wheel and the shroud structure that is sufficient to cause abrading of the metal, either on the shroud structure or the turbine tip. Not only is there a permanent increase in clearance, there is a possibility that the abraded particles may cause damage to the power turbine downstream of the gasifier turbine.

The foregoing illustrates limitations of the known prior art. Thus, it is apparent that it would be advantageous to provide an alternative to the prior art.

DISCLOSURE OF THE INVENTION

In one aspect of the present invention, this is accomplished by providing a floating expansion control ring in a turbine shroud assembly that includes a pair of manifold rings, a spacer ring positioned between the manifold rings. The spacer ring further defines a plurality of notches on its inner perimeter with each notch having a depth D and a width W. The expansion control ring has a plurality of lugs extending outward from the outer perimeter thereof with each lug having a width less than the width W of a corresponding notch in the spacer ring so that the lugs may be received in the notches.

In previous gas turbine shroud assemblies, it has been necessary to include either abradable shroud segments or abradable tips on the turbine blades in order to overcome contact between the turbine blades and the shroud structure. This invention permits the shroud structure through a floating expansion control ring to move eccentrically to the axis of the engine thereby maintaining concentricity with the turbine wheel.

The foregoing and other aspects will become apparent from the following detailed description of the invention when considered in conjunction with the accompanying drawings. It is to be expressly understood, however, that the drawings are not intended as a definition of the invention, but are for the purposes of illustration only.

BRIEF DESCRIPTION OF THE DRAWINGS

FIG. 1 is a portion of a turbine shroud assembly which forms an embodiment of the present invention.

FIG. 2 is a cross-sectional view of the turbine shroud assembly with the associated mounting elements which form an embodiment of the present invention along with a turbine blade.

FIG. 3 is a detailed view of a portion of the spacer ring and the expansion control ring that form an embodiment of the present invention.

FIG. 4 includes a sequence of schematic views of a turbine wheel and the associated shroud structure in the present embodiment and the prior art.

BEST MODE FOR CARRYING OUT THE INVENTION

Referring to FIG. 1, a portion of a turbine shroud assembly 10 is illustrated. A turbine shroud assembly such as the shroud assembly 10 shown in FIG. 1 is applicable for use in a turbine engine, in particular in a gas turbine engine, to surround the turbine wheel 11 (shown schematically in FIGS. 4A–E) which has extending outwardly therefrom a plurality of blades 12 upon which a stream of hot gases, as indicated by the arrow G, impinge.

As shown in FIG. 1, the shroud assembly 10 is comprised of three major portions, a spacer ring 14, a pair of manifold rings 28 and 30, and an expansion control ring 20. The spacer ring 14 is the outermost portion and has formed therein a plurality of notches 16, each adapted to receive a corresponding lug 18 formed on an outwardly extending web 32 of expansion control ring 20. Expansion control ring 20 has positioned thereon a plurality of shroud segments 22. Shroud segments 22 and expansion control 20 provide the floating interface between the spacer ring 14 which is fixed to the surrounding engine and the rotating turbine blades 12.

Referring now to FIG. 2, it can be seen how expansion control ring 20 and the associated shroud segments 22 are floatingly affixed to the engine casing 24. Spacer ring 14 is formed with a plurality of holes 26 through which a corresponding plurality of bolts 27 may be passed. On either side of spacer ring 14 are manifold rings 28 and 30, respectively. The purpose of these manifold rings is more clearly set forth in U.S. Pat. No. 4,251,185. Suffice it to say these rings in addition to providing support for the shroud assembly direct cooling air to the shroud assembly.

As can be seen in FIG. 2, bolt 27 passes through and thus affixes the manifold rings 28 and 30 and the spacer ring 14 to the engine casing 24.

Spacer ring 14 has a slightly thicker dimension $T_1$ than the thickness $T_2$ of the web 32 of expansion control ring 20. This greater thickness permits eccentric planar movement of expansion control ring 20 relative the manifold rings 28 and 30 and spacer ring 14.

Referring now to FIG. 3, an enlarged view of a portion of expansion control ring 20 is shown relative spacer ring 14. Expansion control ring 20 has an outer perimeter 34 which has a radius $R_1$ while spacer ring 14 has an inner perimeter 36 having a radius $R_2$. It should be apparent that radius $R_2$ is greater than radius $R_1$ by a predetermined amount. Similarly, in FIG. 3 it can be seen that each lug 18 has a width $W_1$ while each notch 16 has a width $W_2$. Further, the depth of each notch is equal to a predetermined amount D, while the height of each lug is equal to H.

The relationship between each notch and each lug may now be defined as:

$$\frac{W_2 - W_1}{2} < [(R_2 + D) - (R_1 + H)].$$

This prestablished clearance relationship results in a clearance ($W_2$ minus $W_1$) sufficient for limited or controlled planar movement in all directions of the expansion control ring to an eccentric position relative to the ring.

Industrial Applicability

With the parts assembled as set forth above, the expansion control ring 20 in a gas turbine engine may move eccentrically as described in the following paragraphs.

Referring now to FIG. 4A, the expansion control ring as shown schematically as a circle at 20, while the spacer ring is also shown schematically as a circle at 14. A schematic turbine wheel 11 with associated turbine blades 12 is shown in an at rest position at FIG. 4A. Prior art devices having abradable shroud segments, such as is described in U.S. Pat. No. 4,251,185 noted above, will take the configuration shown in FIG. 4B should there be a D lack of concentricity between the turbine shroud 20′ and the turbine wheel 11′ upon start-up or during operation of the engine. In particular, in FIG. 4B it can be seen that the turbine wheel 11′ has moved downwardly so that the associated turbine blades 12′ will come in contact with expansion control ring 20′. With an abradable structure, the expansion control ring then becomes out of round as indicated in FIG. C. This out of round condition will result in loss of efficiency in the turbine engine due to the increased gap between the blades and the turbine wheel, as shown in FIG. 4C. It is understood that the illustrations in FIG. 4 are exaggerated to better define the problem.

Should there be "squealer tip"-type blades as described in the background of this invention, the results will be best illustrated by referring to FIG. 4D wherein the actual blades 12″ are reduced in length about the entire turbine wheel. Should this occur, the loss of efficiency is much greater than in the embodiment shown in FIG. 4C. In FIG. 4D, the "squealer tip" blades 12″ have been worn away so that the clearance between the blades 12″ and the expansion control ring 20″ is increased concentrically. Of course, the spacer ring 14″ and the turbine wheel 11″ remain unaffected.

The present invention is shown schematically in FIG. 4E wherein the turbine wheel 11 is eccentric to the housing as represented by spacer ring 14. As a result of the eccentricity of the turbine wheel 11, initial contact is made between the blades 12 and the shroud segment 22 best illustrated in FIG. 2 with a resultant movement of the expansion control ring 20 from its concentric position represented by the phantom circle 200, to an eccentric position relative the engine axis 40, but maintaining concentricity with the turbine wheel 11. As the turbine wheel moves back into a concentric relationship with the turbine axis 40, the expansion control ring 20 is free to move or float relative the turbine wheel. Thus, lugs 18 and notches 20 provide means for expansion control ring 20 to maintain general concentricity with turbine wheel 11, even though turbine wheel 11 is running eccentrically to the engine axis 40.

Referring now to FIGS. 1 and 3, it can be seen that the expansion control ring 20 has controlled freedom for planar movement in an eccentric manner in all directions about the engine axis 40 due to the preestablished radial clearance of $R_2-R_1$, and the circumferential clearance $W_2-W_1$. Concurrently, sufficient gap is maintained between the expansion control ring 20 and the spacer ring 14 so that any variation in the rate of expansion between the expansion control ring and the spacer ring 14 may take place without serious injury to the internal portions of the engine. It is appropriate to make the clearances between the sides of the lugs 18 and notches 16 less than the clearances between the end of the notches 16 and lugs 18 so that the eccentric movement of the expansion ring will be controlled by the side clearance. It is also important to understand that the clearance between the sides of the lugs and notches is not made so large so that there will be excessive movement, rather the fit should be sufficiently tight so that movement is dampened between the two portions.

The aforedescribed invention has particular advantages in that it overcomes the necessity for using either an abradable shroud or a "squealer tip" as described in the background of this invention. In the past, abradable shrouds have been subject to oxidation and corrosion due to the high gas temperatures and have further suffered from erosion due to the high gas velocities after a short period of time. Thus, in addition to the possibility of the permanent eccentricity as shown in FIG. 4C above, the actual clearance between the turbine wheel and the expansion control ring 20 will increase due to this erosion and corrosion problem. When the "squealer tips" are used on all blades of the turbine wheel, there is a permanent increased clearance between all the blades and the shroud structure as shown in FIG. 4D. Furthermore, when there are cooling passages located in the turbine blades 12, the abrasion around the end of the "squealer tip" may block off the air flow through the turbine blade, thereby having a deleterious effect on the cooling of the engine itself.

While the present invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the scope thereof. Therefore, it is intended that the invention not be limited to the particular embodiments disclosed, but that the invention will include all embodiments falling within the intended scope of the claims.

We claim:

1. A turbine shroud assembly having a pair of manifold rings (28,30), a spacer ring (14) positioned between said manifold rings (28,30), said spacer ring (14) defining a plurality of notches (16) on its inner perimeter, said inner perimeter having a radius $R_2$, each notch (16) having a depth D and a width $W_2$, the improvement comprising an expansion control ring (20) floatingly positioned within said spacer ring, said expansion control ring (20) having an outer perimeter with a radius $R_1$ where $R_1$ is less than $R_2$, said expansion control ring (20) further having a plurality of lugs (18) extending outwardly at said outer perimeter into said notches, each of said lugs (18) having a width $W_1$; where $W_1$ is less than $W_2$ so that said expansion control ring has limited freedom for planar movement to an eccentric position relative to the spacer ring.

2. A turbine machine having a housing defining an axis, a turbine wheel axially mounted for rotation in said housing, and a shroud assembly mounted concentrically about said axis and about said turbine wheel, said shroud assembly including a pair of rings; a spacer ring positioned between said rings; and an expansion control ring, the improvement comprising said spacer ring and said expansion control ring having means for permitting controlled planar movement normal to the axis (40) of the expansion control ring in all directions to an eccentric position relative to the engine axis and maintain general concentricity with the turbine wheel while said turbine wheel is running eccentrically and concentrically to the engine axis.

3. The turbine machine of claim 2 wherein said means for permitting the controlled planar movement includes a plurality of notches formed on the inner perimeter of said spacer rings; a corresponding plurality of outwardly extending lugs formed on the outer perimeter of said expansion control ring and extending into said notches; each of said notches having a width greater then a width of the corresponding lug on the expansion control ring.

4. A turbine shroud assembly having a pair of rings, a spacer ring positioned between the rings and having an inner perimeter, and an expansion control ring positioned within the spacer ring and having an outer perimeter, said outer perimeter having a radius $R_1$ and said inner perimeter having a radius $R_2$ wherein $R_1$ is less than $R_2$, one of said perimeters having a plurality of notches and the other of said perimeters having a plurality of lugs extending into said notches, the improvement comprising each of said notches having a width $W_2$ and each of said lugs having a width $W_1$, said width $W_1$ being less than said width $W_2$ sufficient for controlled planar movement in all directions of the expansion control ring to an eccentric position relative to the spacer ring.

* * * * *